US007138765B2

(12) United States Patent
Anami et al.

(10) Patent No.: US 7,138,765 B2
(45) Date of Patent: Nov. 21, 2006

(54) HIGH EFFICACY LAMP IN A CONFIGURED CHAMBER

(75) Inventors: Shinichi Anami, Wellesley, MA (US); Nanu Brates, Winchester, MA (US); Stefaan M. Lambrechts, Beverly, MA (US); Huiling Zhu, Lexington, MA (US); Jakob Maya, Brookline, MA (US)

(73) Assignees: Matsushita Electric Industrial Co., Ltd., Osaka (JP); Matsushita Electric Works, Ltd., Osaka (JP)

( * ) Notice: Subject to any disclaimer, the term of this patent is extended or adjusted under 35 U.S.C. 154(b) by 203 days.

(21) Appl. No.: 10/657,380

(22) Filed: Sep. 8, 2003

(65) Prior Publication Data

US 2005/0052139 A1 Mar. 10, 2005

(51) Int. Cl.
*H05B 31/38* (2006.01)
*H05B 31/00* (2006.01)

(52) U.S. Cl. ..... 313/620; 313/637; 313/639; 313/634

(58) Field of Classification Search ..... 313/620, 313/634

See application file for complete search history.

(56) References Cited

U.S. PATENT DOCUMENTS

| | | | | |
|---|---|---|---|---|
| 3,786,297 | A | 1/1974 | Zollweg et al. | |
| 5,153,482 | A * | 10/1992 | Keijser et al. | 313/634 |
| 5,973,453 | A | 10/1999 | Van Vliet et al. | |
| 6,130,511 | A * | 10/2000 | Rothwell et al. | 315/246 |
| 6,300,729 | B1 * | 10/2001 | Keijser et al. | 313/620 |

FOREIGN PATENT DOCUMENTS

| | | |
|---|---|---|
| JP | 56091368 | 7/1981 |

* cited by examiner

*Primary Examiner*—Mariceli Santiago
*Assistant Examiner*—Elizabeth Rielley
(74) *Attorney, Agent, or Firm*—Kinney & Lange, P.A.

(57) ABSTRACT

An arc discharge metal halide lamp having a discharge chamber having visible light permeable walls bounding a discharge region supported electrodes in a discharge region spaced apart by a distance $L_e$ with an average interior diameter equal to D so they have a selected ratio. Ionizable materials are provided in this chamber involving a noble gas, one or more halides, and mercury in an amount sufficiently small so as to result in a relatively low maximum voltage drop between the electrodes during lamp operation.

16 Claims, 5 Drawing Sheets

HIGH EFFICACY LAMP IN A CONFIGURED CHAMBER

BACKGROUND OF THE INVENTION

This invention relates to high intensity arc discharge lamps and more particularly to high intensity arc discharge metal halide lamps having high efficacy.

Due to the ever-increasing need for energy conserving lighting systems that are used for interior and exterior lighting, lamps with increasing lamp efficacy are being developed for general lighting applications. Thus, for instance, arc discharge metal halide lamps are being more and more widely used for interior and exterior lighting. Such lamps are well known and include a light transmissive arc discharge chamber sealed about an enclosed a pair of spaced apart electrodes, and typically further contain suitable active materials such as an inert starting gas and one or more ionizable metals or metal halides in specified molar ratios, or both. They can be relatively low power lamps operated in standard alternating current light sockets at the usual 120 Volts rms potential with a ballast circuit, either magnetic or electronic, to provide a starting voltage and current limiting during subsequent operation.

These lamps typically have a ceramic material arc discharge chamber that usually contains quantities of metal halides such as $CeI_3$ and NaI, (or $PrI_3$ and NaI) and T1I, as well as mercury to provide an adequate voltage drop or loading between the electrodes, and also an inert ionization starting gas. Such lamps can have an efficacy as high as 145 LPW at 250 W with a Color Rendering Index (CRI) higher than 60, and with a Correlated Color Temperature (CCT) between 3000K and 6000K at 250 W.

Of course, to further save electric energy in lighting by using more efficient lamps, high intensity arc discharge metal halide lamps with even higher lamp efficacies are needed. The efficacy of a lamp is affected by the shape of the arc discharge chamber therein. If the ratio between the distance separating the electrodes in the arc discharge chamber to the diameter of the chamber is too small, such as being less than four, the relative abundance of Na between the arc and the chamber walls leads to a lot of absorption of generated light radiation by such Na due to its absorption lines near the peak values of visible light. Also, if this ratio is less than five, the lamp operated with its length positioned horizontally results in the arc established in the arc discharge chamber substantially bending upward due the buoyancy of its vaporized chamber constituents. This upward bending of the arc brings it nearer to the wall of the arc discharge chamber near the peak of the bend, and so raises the temperature of the chamber wall in that vicinity. Such temperature increases can accelerate reactions of some of these vaporized constituents in the chamber and the elevated temperature portions of the chamber wall to thereby ultimately result in the destruction of the wall integrity, and so reduce the operating life of the lamp when operated horizontally.

On the other hand, if the ratio between the distance separating the electrodes in the chamber to the diameter of the chamber is too great, such as being greater than five, initiating an arc discharge in the arc discharge chamber is difficult because of the relatively large breakdown distance between the electrodes. In addition, such lamps perform relatively poorly when the long dimension thereof is oriented vertically during operation in exhibiting severe colors segregation as the different buoyancies of the lamp content constituents cause them to segregate themselves from one another to a considerable degree along the arc length, and reduced efficacy.

Increased pressures in the arc discharge chamber of either the mercury or the starting gas constituents therein, although having some helpful effects on such color segregation and on efficiency, also has detrimental aspects. Increased starting gas pressure is usually insufficient by itself to achieve these goals, and increased mercury pressure leads to needing to generate high operating voltages between the chamber electrodes and also to substantial discharge arc bending bringing the arc closer to the wall of the chamber to thereby shorten the operational duration of the lamp. Thus, there is a desire for arc discharge metal halide lamps having higher efficacies and better color performance.

BRIEF SUMMARY OF THE INVENTION

The present invention provides an arc discharge metal halide lamp for use in selected lighting fixtures comprising a discharge chamber having visible light permeable walls of a selected shape bounding a discharge region through which walls a pair of electrodes are supported in the discharge region and which are spaced apart from one another by a distance $L_e$. These walls about the discharge region have an average interior diameter over $L_e$, that is equal to D so they are related to have $L_e/D \leqq 5$ and even $4 < L_e/D \leqq 5$. Ionizable materials are provided in this chamber discharge region comprising a noble gas, a cerium halide or sodium halide or both, and mercury in an amount sufficiently small so as to result in a voltage drop between the electrodes during lamp operation that is less than 110 V rms at a selected value of electrical power dissipation in the lamp.

DETAILED DESCRIPTION

Figure 1:
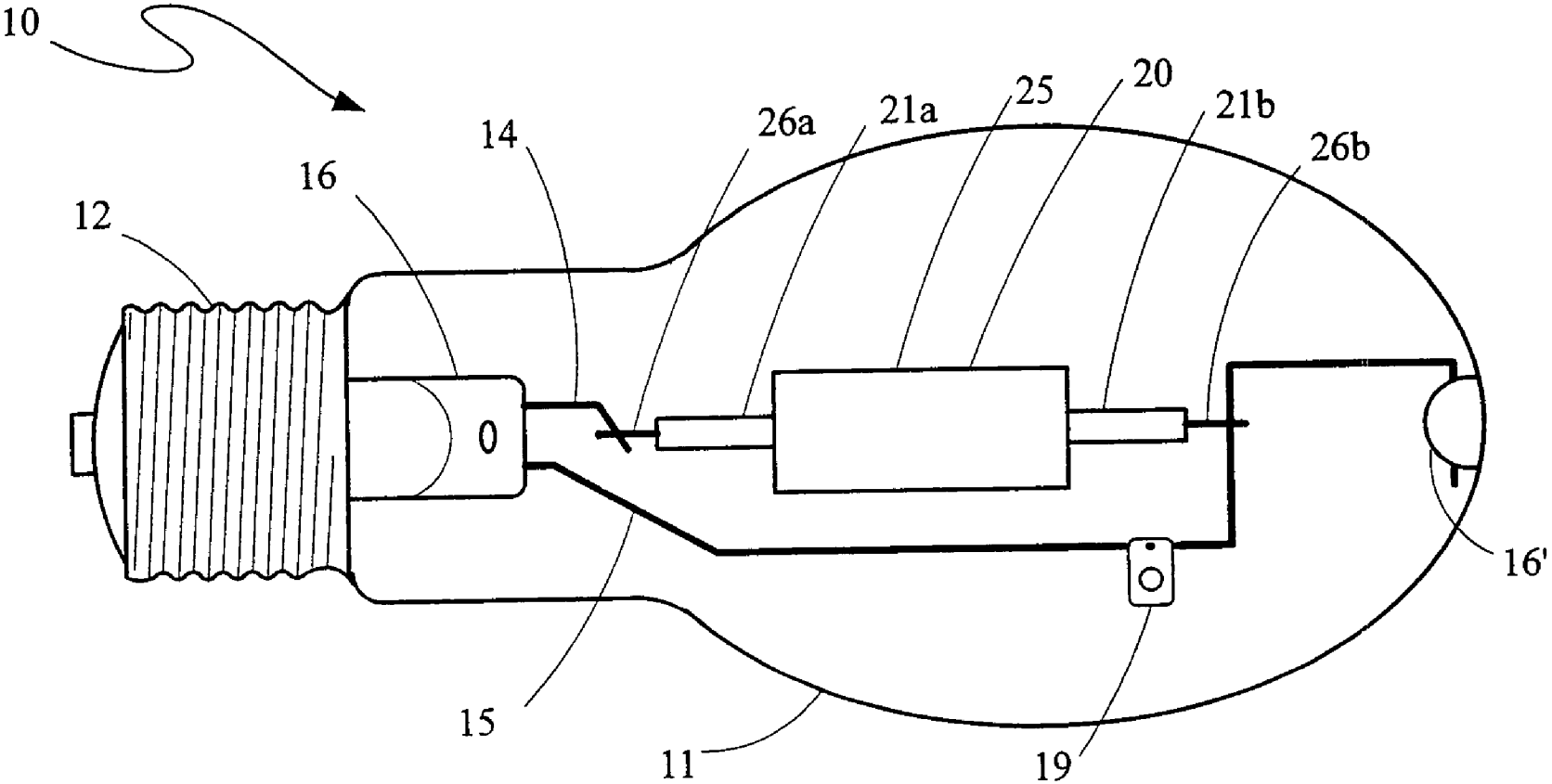
FIG. 1 is a side view, partially in cross section, of an arc discharge metal halide lamp of the present invention having a ceramic arc discharge chamber of a selected configuration therein.

Referring to FIG. 1, an arc discharge metal halide lamp, 10, is shown in a side view having a bulbous, transparent borosilicate glass envelope, 11, fitted into a conventional Edison-type metal base, 12. Lead-in, or electrical access, electrode wires, 14 and 15, of nickel or soft steel, each extend from acorresponding one of the two electrically isolated electrode metal portions in base 12 parallely through and past a borosilicate glass flare, 16, positioned at the location of base 12 and extending into the interior of envelope 11 along the axis of the major length extent of that envelope. Electrical access wires 14 and 15 extend initially on either side of, and in a direction parallel to, the envelope length axis past flare 16 to have portions thereof located further into the interior of envelope 11 with access wire 15 extending after some bending into a borosilicate glass dimple, 16', at the opposite end of envelope 11. Electrical access wire 14 is provided with a second section in the interior of envelope 11, extending at an angle to the first section that parallels the envelope length axis, by having this second section welded at such an angle to the first section so that it ends after more or less crossing the envelope length axis.

Some remaining portion of access wire 15 in the interior of envelope 11 is bent at an obtuse angle away from the initial direction thereof parallel to the envelope length axis. Access wire 15 with this first bend therein past flare 16 directing it away from the envelope length axis, is bent again to have the next portion thereof extend substantially parallel that axis, and further along bent again at a right angle to have the succeeding portion thereof extend substantially perpendicular to, and more or less cross that axis near the other end of envelope 11 opposite that end thereof fitted into base 12. The succeeding portion of wire 15 parallel to the envelope length axis supports a conventional getter, 19, to capture gaseous impurities. Three additional right angle bends are provided further along in wire 15 to thereby place a short remaining end portion of that wire below and parallel to the portion thereof originally described as crossing the envelope length axis which short end portion is finally anchored at this far end of envelope 11 from base 12 in glass dimple 16'.

A ceramic arc discharge chamber, 20, configured about a contained region as a shell structure having polycrystalline alumina walls that are translucent to visible light, is shown in one of various possible geometric configurations in FIG. 1. Alternatively, the walls of arc discharge chamber 20 could be formed of aluminum nitride, yttria ($Y_2O_3$), sapphire ($Al_2O_3$), or some combinations thereof. Discharge chamber 20 is provided in the interior of envelope 11 which interior can otherwise either be evacuated, to thereby reduce the heat transmitted to the envelope from the chamber, or can instead be provided with an inert gaseous atmosphere such as nitrogen at a pressure greater than 300 Torr to thereby increase that heat transmission if operating the chamber at a lower temperature is desired. The region enclosed in arc discharge chamber 20 contains various ionizable materials, including metal halides and mercury which emit light during lamp operation and a starting gas such as the noble gases argon (Ar), xenon (Xe) or neon (Ne).

Figure 2:
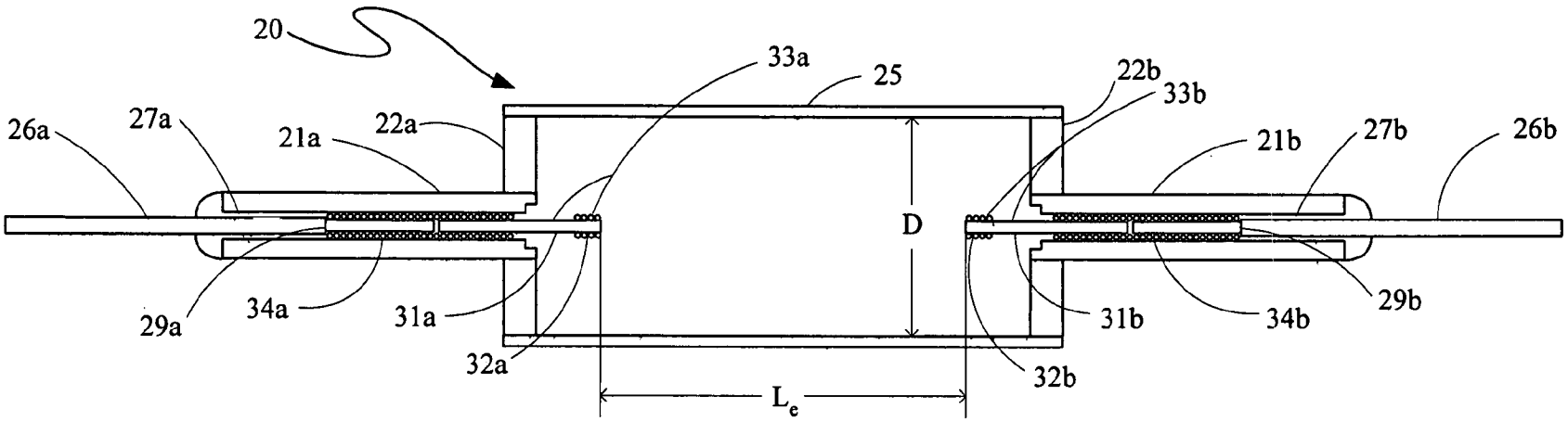
FIG. 2 shows the arc discharge chamber of FIG. 1 in cross section in an expanded view.

In this structure for arc discharge chamber 20, as better seen in the cross section view thereof in FIG. 2, a pair of polycrystalline alumina, relatively small inner and outer diameter truncated cylindrical shell portions, or capillary tubes, 21*a* and 21*b*, are each concentrically joined to a corresponding one of a pair of polycrystalline alumina end closing disks, 22*a* and 22*b*, about a centered hole therethrough so that an open passageway extends through each capillary tube and through the hole in the disk to which it is joined. These end closing disks are each joined to a corresponding end of a polycrystalline alumina tube, 25, formed as a relatively large diameter truncated cylindrical shell with that diameter designated as D, so as together to be about the enclosed region in providing the primary arc discharge chamber. The total length of the enclosed space in chamber 20 extends between the junctures of tubes 21*a* and 21*b* with the corresponding one of closing end disks 22*a* and 22*b*. The length of primary central portion chamber structure 25 of chamber 20 extends between the junctures therewith and each of closing end disks 22*a* and 22*b*. These various portions of arc discharge tube 20 are formed by compacting alumina powder into the desired shape followed by sintering the resulting compact to thereby provide the preformed portions, and the various preformed portions are joined together by sintering to result in a preformed single body of the desired dimensions having walls impervious to the flow of gases.

Chamber electrode interconnection wires, 26*a* and 26*b*, of niobium each extend out of a corresponding one of tubes 21*a* and 21*b* to reach and be attached by welding to, respectively, access wire 14 at its end portion crossing the envelope length axis and to access wire 15 at its portion first described as crossing the envelope length axis. This arrangement results in chamber 20 being positioned and supported between these portions of access wires 14 and 15 so that its long dimension axis approximately coincides with the envelope length axis, and further allows electrical power to be provided through access wires 14 and 15 to chamber 20.

FIG. 2 shows the discharge region contained within the bounding walls of arc discharge chamber 20 that are provided by structure 25, disks 22*a* and 22*b*, and tubes 21*a* and 21*b* of FIGS. 1 and 2. Chamber electrode interconnection wire 26*a*, being of niobium, has a thermal expansion characteristic that relatively closely matches that of tube 21*a* and that of a glass frit, 27*a*, affixing wire 26*a* to the inner surface of tube 21*a* (and hermetically sealing that interconnection wire opening with wire 26*a* passing therethrough) but cannot withstand the resulting chemical attack resulting from the forming of a plasma in the main volume of chamber 20 during operation. Thus, a molybdenum lead-through wire, 29*a*, which can withstand operation in the plasma, is connected to one end of interconnection wire 26*a* by welding, and the other end of lead-through-wire 29*a* is connected to one end of a tungsten main electrode shaft, 31*a*, by welding.

In addition, a tungsten electrode coil, 32*a*, is integrated and mounted to the tip portion of the other end of the first main electrode shaft 31*a* by welding, so that an electrode, 33*a*, is configured by main electrode shaft 31*a* and electrode coil 32*a*. Electrode 33*a* is formed of tungsten for good thermionic emission of electrons while withstanding relatively well the chemical attack of the metal halide plasma. Lead-through wire 29*a*, spaced from tube 21*a* by a molybdenum coil, 34*a*, serves to dispose electrode 33*a* at a predetermined position in the region contained in the main volume of arc discharge chamber 20. A typical diameter of interconnection wire 26*a* is 0.9 mm, and a typical diameter of electrode shaft 31*a* is 0.5 mm.

Similarly, in FIG. 2, chamber electrode interconnection wire 26*b* is affixed by a glass frit, 27*b*, to the inner surface of tube 21*b* (and hermetically sealing that interconnection wire opening with wire 26*b* passing therethrough). A molybdenum lead-through wire, 29*b*, is connected to one end of interconnection wire 26*b* by welding, and the other end of lead-through-wire 29*b* is connected to one end of a tungsten main electrode shaft, 31*b*, by welding. A tungsten electrode coil, 32*b*, is integrated and mounted to the tip portion of the other end of the first main electrode shaft 31*b* by welding, so that an electrode, 33*b*, is configured by main electrode shaft 31*b* and electrode coil 32*b*. Lead-through wire 29*b*, spaced from tube 21*b* by a molybdenum coil, 34*b*, serves to dispose electrode 33*b* at a predetermined position in the region contained in the main volume of arc discharge chamber 20. A typical diameter of interconnection wire 26*b* is also 0.9 mm, and a typical diameter of electrode shaft 31 is again 0.5 mm. The distance between electrodes 33*a* and 33*b* is designated $L_e$.

As indicated above, when arc discharge metal halide lamp 10 has its length oriented in a vertical position during operation, all or nearly all of the chamber contents constituents in arc discharge chamber 20 condense at the then lower end of that chamber and in the then lower capillary tube which could be either of tubes 21*a* and 21*b*. In some situations, some of the chamber content constituents are also present in the then upper capillary tube also. If the discharge vessel is relatively long and narrow, such as $L_e/D>5$, the differing buoyancies of the chamber content constituents cause them to reach different heights in discharge chamber 20, and they do not circulate smoothly from the lower end of the chamber to the higher end thereof.

In such a situation, vaporized chamber content constituents in the lower end of chamber 20 and in the lower one of capillary tubes 21*a* and 21*b* cannot all reach upper end of the chamber, and so the actual vapor pressures of some of the contents constituents in the chamber over the distance between the higher and lower ends of the chamber become lower than the vapor pressures thereof toward the lower end of the chamber. As a result, color segregation in arc discharge chamber 20 occurs in accordance with the segregation of the contents constituents over the chamber length, and this also cause much lower efficacy than the efficacy occurring during operation of the lamp in a horizontal position. Furthermore, if arc discharge chamber 20 is formed to be more oblate in having the ratio $L_e/D \leqq 4$, absorption by sodium of radiation from the discharge arc is increased which causes lower lamp efficacy during lamp operation of the lamp in both the horizontal and vertical positions. As a result, lamp 10 is configured to have arc discharge chamber 20 such the electrode separation distance therein and the primary chamber wall diameter are chosen so as to maintain a ratio relationship satisfying $4<L_e/D \leqq 5$ to thereby achieve high efficacy during operation of lamp 10 in either a vertical position or in a horizontal position.

As also noted above, lamps with an arc discharge chamber having electrode separation to chamber diameter ratios such that $L_e/D \leqq 5$ and which are operated with the length of the lamp extending horizontally, have the discharge arc established in the chamber observed to be bending upward due to the buoyancy of the chamber contents constituents. Such arc bending, as indicated above, increases the temperature of the arc discharge chamber wall portions approached by the bend peak portions of the bending arc to thereby accelerate reactions between at least some of those constituents and those wall portions to thereby significantly affect the structural integrity of the wall.

This temperature rise of some chamber wall portions is particularly severe when the chamber electrode separation distance and the primary chamber wall diameter are chosen, as was indicated above, to satisfy $4<L_e/D \leqq 5$ in attempting to achieve the best lamp efficacies. This severity follows because, in chamber configurations above this range, i.e. in which electrode separations to chamber diameters ratios are such that $L_e/D>5$, the discharge arc position along the chamber central length axis tends to be more stable insofar as departures of the arc position from that axis so as to result in any remaining arc bending thus being of moderate magnitude. Below the other end of this range in which $L_e/D \leqq 4$, the distance from the discharge arc to the wall of the arc discharge chamber is always enough to avoid excessive temperature rises at the nearest wall portions of that chamber even in those situations in which arc bending is severe.

Figure 3:
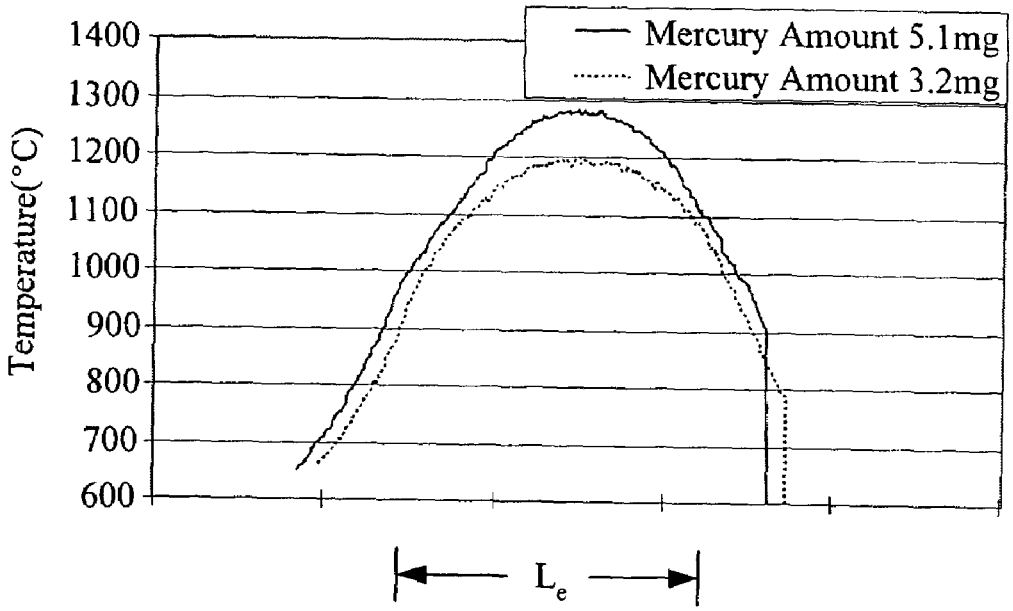
FIG. 3 shows a graph of arc discharge chamber wall temperatures at a location therein during lamp operation under selected conditions.
Figure 4:
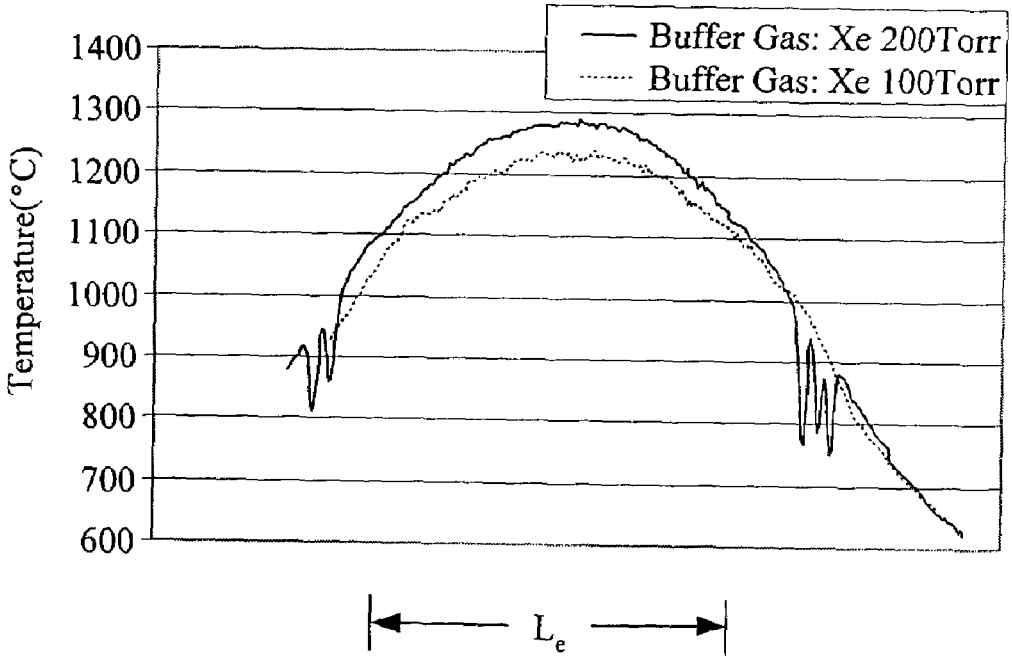
FIG. 4 shows a graph of arc discharge chamber wall temperatures at a location therein during lamp operation under other selected conditions.

In this regard, such bending of the discharge arc in the arc discharge chamber is seen in then graph of FIG. 3 to be substantially correlated with the mercury vapor pressure in the chamber during operation which pressure is essentially set by the amount of the mercury constituent introduced in the chamber at manufacture, and also is seen in the graph of FIG. 4 to be substantially correlated with the chamber pressure of the ionization starting, or buffer, gas which pressure is also set at the time of manufacture. FIG. 3 graphically shows examples of temperature profiles along lines at the top of the wall of two arc discharge chambers over the distance between chamber electrodes, paralleling the length axes of these chambers that pass through those electrodes therein, which are in corresponding lamps that are both operated with these length axes in a horizontal position, and at the same input electrical power, but with the different mercury amounts in the corresponding chambers that are indicated by the mercury amounts shown on the graph. In detail, the arc discharge chambers in these two lamps each had $L_e/D=4.1$ with the length of the discharge arc being 28.9 mm, and each had a wall loading of 33.6 W/cm$^2$ when operated at 250 W of electrical power. The arc discharge chamber contents were 15.4 mg total of the metal halides NaI, $CeI_3$ and TlI in molar ratios 1:19.7:0.56 with Xe also provided therein at a pressure of 200 Torr.

FIG. 4 graphically also shows examples of temperature profiles along lines at the top of the wall of two arc discharge chambers over the distance between chamber electrodes, paralleling the length axes of these chambers that pass through those electrodes therein, which are in corresponding lamps that are both operated with these length axes in a horizontal position, and at the same input electrical power, but here with the different buffer Xe gas pressures in the corresponding chambers that are again indicated by the Xe pressures shown on the graph. Here again, the arc discharge chambers in these two lamps each had $L_e/D=4.1$ with the length of the discharge arc being 28.9 mm, and each had a wall loading of 33.6 W/cm$^2$ when operated at 250 W of electrical power. The arc discharge chamber contents here, however, were 15.0 mg total of the metal halides NaI and $CeI_3$ in a molar ratio of 1:10.5 with Hg also provided therein in a quantity of 4.6 mg. These relationships between arc discharge chamber wall temperatures and quantities of mercury and xenon in the chamber thus allow moderating the bending of the discharge arc in the arc discharge chamber during operation by decreasing the mercury vapor pressure in the chamber or by decreasing the buffer gas pressure in the chamber, or both, through introducing sufficiently small amounts of each in the chamber at the point of manufacture to obtain the result shown in these graphs of reduced chamber wall temperatures during horizontal lamp operation.

The presence of mercury and the starting gas in the arc discharge chamber primarily provides the voltage drop or loading between the chamber electrodes during lamp operation. Thus, choosing to use smaller amounts of mercury or the starting gas (Xe in the examples above) results in reducing the voltage drop between the chamber electrodes during lamp operation. Suitable choices for such amounts can therefore be found from the relationships between lamp efficacy (in lumens per Watt), the lamp Color Rendering Index (CRI) and the operating voltage of the lamp between its chamber electrodes in view of such lamps for outdoor lighting being desired to have efficacies of 120 to 140 LPW and CRI values from 50 to 70 to provide advantages over currently used high pressure sodium lamps.

Figure 5:
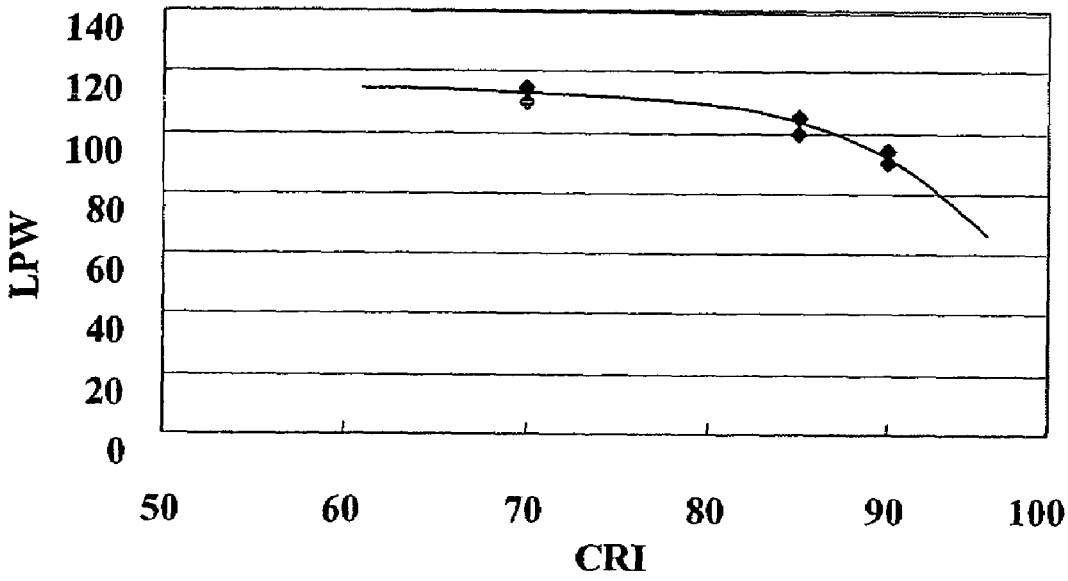
FIG. 5 shows a graph of selected lamp parameters plotted against one another.
Figure 6:
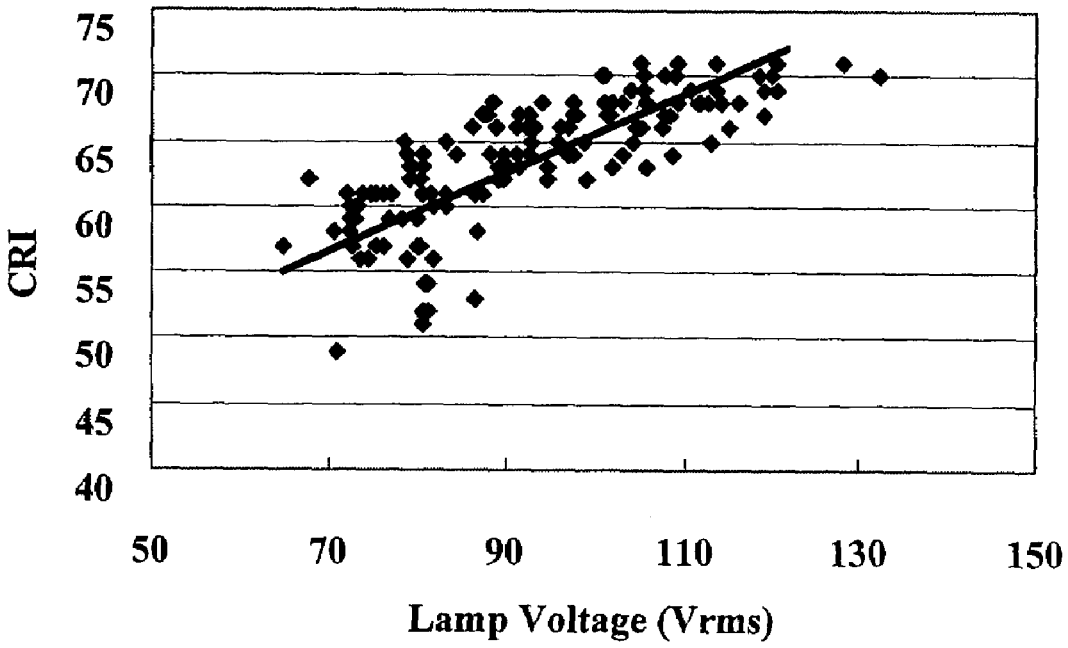
FIG. 6 shows a graph of selected lamp parameters plotted against one another.

As shown in the graphs of FIGS. 5 and 6, there are inverse relationships between lamp efficacy, lamp CRI and the lamp operating voltage. For an acceptable white light source with acceptable coloration, the lamp CRI, as indicated above, needs to be in the range of 50 to 70. As can be seen from FIG. 6 showing the relationship between lamp CRI and lamp operating voltage, keeping the voltage drop between the lamp electrodes during operation below 100V by quantity choices for the mercury and starting gas constituents of the chamber contents, chamber shape, and the like, enables maintaining a lamp CRI of between 50 and 70. Yet, from FIG. 5 showing the relationship between lamp efficacy and CRI, lamps operated with such an operating voltage will have sufficiently large efficacy in the range of 120 to 140 LPW to be competitive with high pressure sodium lamps.

Figure 7:
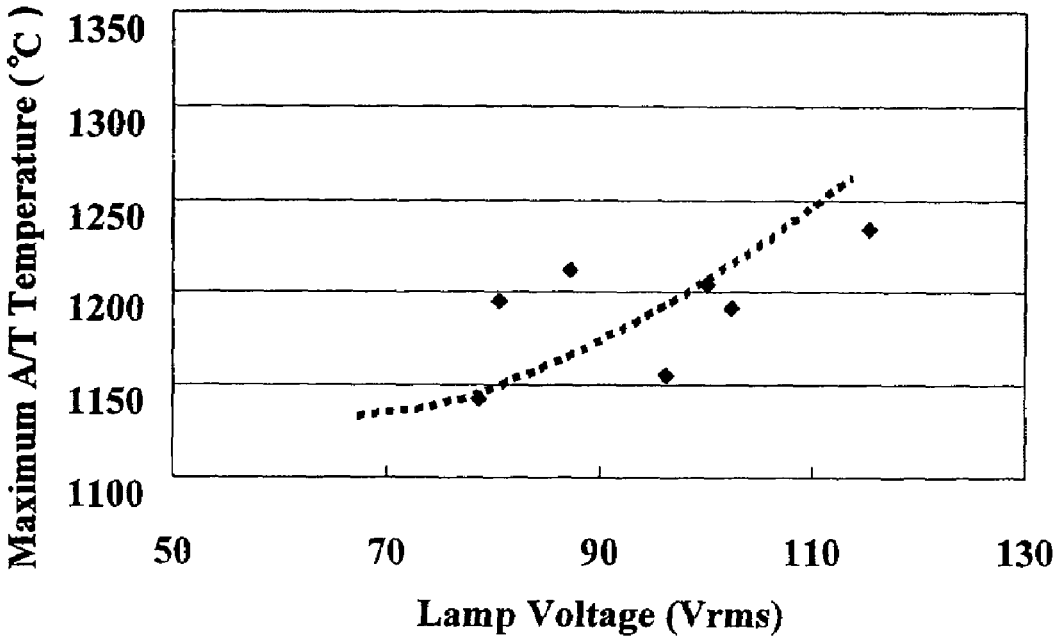
FIG. 7 shows a graph of wall temperatures of a lamp arc discharge chamber plotted against a selected lamp parameter.
Figure 8:
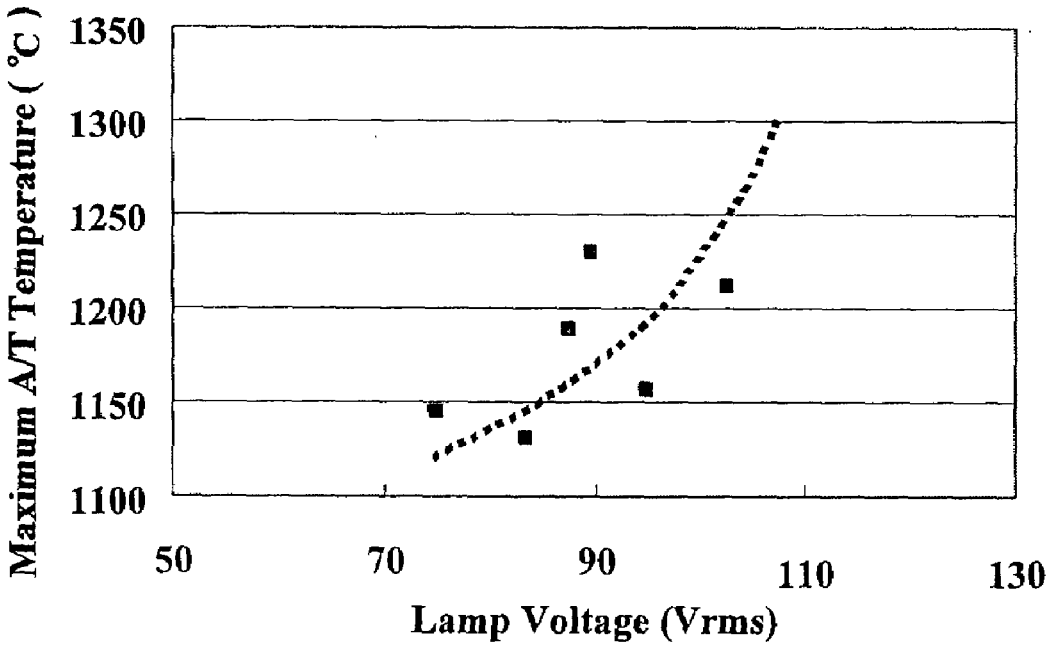
FIG. 8 shows a graph of wall temperatures of another lamp arc discharge chamber plotted against a selected lamp parameter.

As described above, keeping the lamp operating voltage relatively low through correlates with less bending of the discharge arc and so relatively safer operation of the arc discharge chamber because of the resulting reduced temperatures at the top of the discharge chamber wall during lamp horizontal operation. Such temperatures otherwise sometimes lead to cracking of the ceramic chamber wall or some other catastrophic failure due to chemical reactions therewith at very high temperatures. Confirming data is shown in the graphs of FIGS. 7 and 8 where the arc discharge chamber maximum wall temperatures are plotted against lamp operating voltage for arc discharge chambers (arc tubes or A/T) of two different shapes having hemispherically shaped ends in the first instance and tapered ends in the second instance. In both instances, keeping the lamp operating voltage below 110V yields maximum arc discharge chamber wall temperatures of less than about 1250° C. there by resulting in relatively safe operation of the lamp and its ceramic arc discharge chamber.

Some examples illustrating the foregoing lamp configurations follow:

EXAMPLE 1

The lamps of this example each have an arc discharge chamber with a ratio of chamber electrode separation distance to the primary chamber wall diameter relationship of $L_e/D=4.8$ in which the discharge arc has a 24 mm length, the chamber also having 33.2 W/cm$^2$ wall loading when the lamp is operated to dissipate 150 W of electrical power. The contents of each corresponding lamp arc discharge chamber comprise 15 mg total of metal halides NaI and $CeI_3$ in the molar ratio of $CeI_3$:NaI=1:10.5, and further include 2.2 mg of Hg and Xe sufficient to provide a chamber pressure thereof equal to 200 Torr at an ambient temperature of 25° C.

Table 1 displays the resulting photometry performance of these lamps for one being operated with its length axis positioned horizontally and the other with its length axis positioned vertically. The column providing values in lumens indicates the lamp luminous flux, the column providing values in lumens per Watt, or LPW, indicates the lamp efficacy, the column providing values in Kelvins indicates the lamp Correlated Color Temperature (CCT), the next column providing dimensionless numerical entries indicates the lamp Color Rendering Index (CRI), and the last column providing values in Duv indicating lamp radiation color deviation from black body radiation emitted by a black body at the same temperature.

TABLE 1

| Sample Lamp | Position | Wattage (W) | Output (lumens) | Efficacy (lpw) | CCT (K) | CRI | DUV (×100) |
|---|---|---|---|---|---|---|---|
| #1 | Horizontal | 150 | 19150 | 128 | 3528 | 67 | +1.31 |
| #2 | Vertical | 150 | 17890 | 119 | 3071 | 61 | +0.39 |

EXAMPLE 2

The lamps of this example each have an arc discharge chamber with a ratio of chamber electrode separation distance to the primary chamber wall diameter relationship of $L_e/D=4.1$ in which the discharge arc has a 28.9 mm length, the chamber also having 33.6 W/cm$^2$ wall loading when the lamp is operated to dissipate 250 W of electrical power. The contents of each corresponding lamp arc discharge chamber comprise 15 mg total of metal halides NaI and $CeI_3$ in the molar ratio of $CeI_3$:NaI=1:10.5, and further include 3.5 mg of Hg and Xe sufficient to provide a chamber pressure thereof equal to 200 Torr at an ambient temperature of 25° C.

Table 2 displays the resulting photometry performance of these lamps for one being operated with its length axis positioned horizontally and the other with its length axis positioned vertically.

TABLE 2

| Sample Lamp | Position | Wattage (W) | Output (lumens) | Efficacy (lpw) | CCT (K) | CRI | DUV (×100) |
|---|---|---|---|---|---|---|---|
| #3 | Horizontal | 250 | 30750 | 123 | 3649 | 66 | +0.95 |
| #4 | Vertical | 250 | 28750 | 115 | 2968 | 55 | −0.12 |

EXAMPLE 3

The lamps of this example each have an arc discharge chamber with a ratio of chamber electrode separation distance to the primary chamber wall diameter relationship of $L_e/D=4.1$ in which the discharge arc has a 28.9 mm length, the chamber also having 33.6 W/cm$^2$ wall loading when the lamp is operated to dissipate 250 W of electrical power. The contents of each corresponding lamp arc discharge chamber comprise 15.4 mg total of metal halides NaI, $CeI_3$ and TlI in the molar ratios of $CeI_3$:NaI:TlI=1:19.7:0.56, and further include 5.1 mg of Hg in #5 and 3.2 mg of Hg in #6 and Xe in both sufficient to provide a chamber pressure thereof equal to 200 Torr at an ambient temperature of 25° C.

Table 3 displays the resulting photometry performance of these lamps for both being operated with the length axis thereof positioned horizontally. Two further columns of data are included, the column providing values in Volts indicating the voltage dropped across the lamp during operation, and the column in degrees Centigrade indicating the maximum temperature reached on the arc discharge chamber wall during operation. The data for the lamps in this example form the basis for the graph of FIG. 3.

TABLE 3

| Sample Lamp | Position | Wattage (W) | Output (lumens) | Efficacy (lpw) | CCT (K) | CRI | DUV (×100) | Lamp Voltage | Maximum Temp. |
|---|---|---|---|---|---|---|---|---|---|
| #5 | Horizontal | 250 | 32960 | 132.0 | 3330 | 66 | +1.30 | 110 V | 1283° C. |
| #6 | Horizontal | 250 | 34220 | 136.8 | 3805 | 64 | +2.10 | 79 V | 1201° C. |

EXAMPLE 4

The lamp of this example has an arc discharge chamber with a ratio of chamber electrode separation distance to the primary chamber wall diameter relationship of $L_e/D=4.8$ in which the discharge arc has a 25.0 mm length, the chamber also having 33.5 W/cm$^2$ wall loading when the lamp is operated to dissipate 150 W of electrical power. The contents of the lamp arc discharge chamber comprise 15 mg total of metal halides NaI and $CeI_3$ in the molar ratio of $CeI_3$:NaI=1:19.7, and further include 1.7 mg of Hg and Xe sufficient to provide a chamber pressure thereof equal to 200 Torr at an ambient temperature of 25° C.

Table 4 displays the resulting photometry performance of this lamp being operated with the length axis thereof positioned horizontally.

TABLE 4

| Sample Lamp | Position | Wattage (W) | Output (lumens) | Efficacy (lpw) | CCT (K) | CRI | DUV (×100) | Lamp Voltage | Maximum Temp. |
|---|---|---|---|---|---|---|---|---|---|
| #7 | Horizontal | 150 | 19530 | 130.0 | 3528 | 65 | +1.32 | 94 V | 1149° C. |

EXAMPLE 5

The lamp of this example has an arc discharge chamber with a ratio of chamber electrode separation distance to the primary chamber wall diameter relationship of $L_e/D=4.8$ in which the discharge arc has a 24.0 mm length, the chamber also having 31.3 W/cm$^2$ wall loading when the lamp is operated to dissipate 150 W of electrical power. The contents of the lamp arc discharge chamber comprise 15 mg total of metal halides NaI and $CeI_3$ in the molar ratio of $CeI_3$:NaI=1:10.5, and further include 1.7 mg of Hg and Xe sufficient to provide a chamber pressure thereof equal to 200 Torr at an ambient temperature of 25° C.

Table 4 displays the resulting photometry performance of this lamp being operated with the length axis thereof positioned horizontally.

TABLE 5

| Sample Lamp | Position | Wattage (W) | Output (lumens) | Efficacy (lpw) | CCT (K) | CRI | DUV (×100) | Lamp Voltage | Maximum Temp. |
|---|---|---|---|---|---|---|---|---|---|
| #8 | Horizontal | 150 | 18693 | 124.5 | 3838 | 66 | +1.83 | 90 V | 1145° C. |

Thus, the lamps of the present invention with a relatively small amounts of the chamber 20 contents constituent mercury and the constituent xenon, as the buffer gas, have a relatively small voltage dropped there across during operation, that is, $V_{lamp} \leqq 110V$ rms, while dissipating nominal electrical power. The result is moderate bending of the discharge arc during operation of lamp 10 with its length axis positioned horizontally, and consequently, lamp 10 will have both a long operational life and high reliability.

Although the present invention has been described with reference to preferred embodiments, workers skilled in the art will recognize that changes may be made in form and detail without departing from the spirit and scope of the invention.

The invention claimed is:

1. An arc discharge metal halide lamp for use in selected lighting fixtures, said lamp comprising:

a discharge chamber having visible light permeable walls of a selected shape bounding a discharge region through which walls a pair of electrodes are supported in said discharge region spaced apart from one another by a distance $L_e$ with said walls about said discharge region having an average diameter along $L_e$ equal to D so as to satisfy $4<L_e/D\leqq 5$; and ionizable materials provided in said discharge region of said discharge chamber comprising a noble gas, a sodium halide and mercury in an amount sufficiently small to result in a voltage drop between said electrodes during lamp operation that is less than 110 V rms at a selected value of electrical power dissipation in said lamp.

2. The device of claim 1 wherein said voltage drop between said electrodes during lamp operation exceeds 50 V rms.

3. The device of claim 2 wherein said voltage drop between said electrodes during lamp operation is between 50 and 100 V rms.

4. The device of claim 1 wherein said discharge chamber is made of a ceramic material.

5. The device of claim 4 wherein said ceramic material is polycrystalline alumina.

6. The device of claim 1 wherein said selected value of electrical power dissipation divided by that surface area of said discharge chamber adjacent to said discharge region as a chamber wall loading is between 30 and 70 W/cm$^2$.

7. The device of claim 1 wherein said selected value of electrical power dissipation divided by that surface area of said discharge chamber adjacent to said discharge region as a chamber wall loading is between 20 and 70 $W/cm^2$.

8. The device of claim 1 wherein said ionizable materials further comprise a cerium halide.

9. An arc discharge metal halide lamp for use in selected lighting fixtures, said lamp comprising:

a discharge chamber having visible light permeable walls of a selected shape bounding a discharge region through which walls a pair of electrodes are supported in said discharge region spaced apart from one another by a distance $L_e$ with said walls about said discharge region having an average diameter along $L_e$ equal to D so as to satisfy $L_e/D \leqq 5$; and ionizable materials provided in said discharge region of said discharge chamber comprising a noble gas, a cerium halide and mercury in an amount sufficiently small to result in a voltage drop between said electrodes during lamp operation that is less than 110 V rms at a selected value of electrical power dissipation in said lamp.

10. The device of claim 9 wherein said voltage drop between said electrodes during lamp operation exceeds 50 V rms.

11. The device of claim 10 wherein said voltage drop between said electrodes during lamp operation is between 50 and 100 V rms.

12. The device of claim 9 wherein said discharge chamber is made of a ceramic material.

13. The device of claim 12 wherein said ceramic material is polycrystalline alumina.

14. The device of claim 9 wherein said selected value of electrical power dissipation divided by that surface area of said discharge chamber adjacent to said discharge region as a chamber wall loading is between 30 and 70 $W/cm^2$.

15. The device of claim 9 wherein said selected value of electrical power dissipation divided by that surface area of said discharge chamber adjacent to said discharge region as a chamber wall loading is between 20 and 70 $W/cm^2$.

16. The device of claim 9 wherein said ionizable materials further comprise a sodium halide.

* * * * *

UNITED STATES PATENT AND TRADEMARK OFFICE

CERTIFICATE OF CORRECTION

PATENT NO. : 7,138,765 B2
APPLICATION NO. : 10/657380
DATED : November 21, 2006
INVENTOR(S) : Shinichi Anami et al.

It is certified that error appears in the above-identified patent and that said Letters Patent is hereby corrected as shown below:

Column 10, Line 48, delete “3” and insert --7--

Column 10, Line 59, delete “4” and insert --3--

Column 10, Line 63, delete “5” and insert --8--; delete “4” and insert --3--

Column 10, Line 65, delete “6” and insert --4--

Column 11, Line 1, delete “7” and insert --5--

Column 11, Line 5, delete “8” and insert --6--

Reorder Claims 3 through 8 so they are in correct numerical sequence

Column 12, Line 4, delete “11” and insert --15--

Column 12, Line 7, delete “12” and insert --11--

Column 12, Line 9, delete “13” and insert --16--

Column 12, Line 11, delete “14” and insert --12--

Column 12, Line 15, delete “15” and insert --13--

UNITED STATES PATENT AND TRADEMARK OFFICE

CERTIFICATE OF CORRECTION

PATENT NO. : 7,138,765 B2
APPLICATION NO. : 10/657380
DATED : November 21, 2006
INVENTOR(S) : Shinichi Anami et al.

It is certified that error appears in the above-identified patent and that said Letters Patent is hereby corrected as shown below:

Column 12, Line 19, delete "16" and insert --14--

Reorder Claims 11 through 16 so they are in correct numerical sequence

Signed and Sealed this

Twenty Second Day of April, 2008

JON W. DUDAS
*Director of the United States Patent and Trademark Office*